US007789058B2

(12) United States Patent
Rotink

(10) Patent No.: US 7,789,058 B2
(45) Date of Patent: Sep. 7, 2010

(54) MIXTURE DISTRIBUTION DEVICE FOR A COMBUSTION ENGINE AND COMBUSTION ENGINE PROVIDED WITH SUCH A MIXTURE DISTRIBUTION DEVICE

(76) Inventor: Martinus Hendrikus Rotink, Steggerdawng 20, 8395PN, Steggerda (NL)

( * ) Notice: Subject to any disclaimer, the term of this patent is extended or adjusted under 35 U.S.C. 154(b) by 356 days.

(21) Appl. No.: 11/952,277

(22) Filed: Dec. 7, 2007

(65) Prior Publication Data

US 2008/0173285 A1 Jul. 24, 2008

(30) Foreign Application Priority Data

Dec. 7, 2006 (NL) ..... 1033015

(51) Int. Cl.
*F02B 31/00* (2006.01)

(52) U.S. Cl. ..... 123/184.24

(58) Field of Classification Search ..... 123/184.21–184.61; 261/23.2
See application file for complete search history.

(56) References Cited

U.S. PATENT DOCUMENTS 4,441,464 A * 4/1984 Toyoda et al. ..... 123/59.5
4,510,896 A * 4/1985 Rutschmann ..... 123/184.34
4,543,918 A * 10/1985 Ma ..... 123/184.42
6,085,712 A * 7/2000 Ma ..... 123/184.42
6,637,396 B2 * 10/2003 Katayama ..... 123/184.42
7,287,502 B2 * 10/2007 Hattori ..... 123/184.21

FOREIGN PATENT DOCUMENTS

| | | |
|---|---|---|
| DE | 3044889 A1 | 7/1982 |
| DE | 3047962 A1 | 7/1982 |
| JP | 60101266 | 6/1985 |
| JP | 6341352 | 12/1994 |

* cited by examiner

*Primary Examiner*—M. McMahon
(74) *Attorney, Agent, or Firm*—Jennifer E. Lacroix, Esq.; DLA Piper LLP (US)

(57) ABSTRACT

A mixture distribution device (1) for a combustion engine comprises a first mixture inlet (3), multiple first mixture outlets (4) and a first branch guiding structure (6). The mixture distribution device further comprises a second mixture distribution device (21) comprising a second mixture inlet (23), as well as multiple second mixture outlets (24) and a second branch guiding structure (26). An air/fuel mixture supplied to the first mixture inlet (3) is divided into a first fraction (7) and a second fraction (27) which is not collected and is collected, respectively, by the second mixture distribution device.

6 Claims, 3 Drawing Sheets

MIXTURE DISTRIBUTION DEVICE FOR A COMBUSTION ENGINE AND COMBUSTION ENGINE PROVIDED WITH SUCH A MIXTURE DISTRIBUTION DEVICE

RELATED APPLICATIONS

This application claims priority to Dutch Application No. 1033015, filed Dec. 7, 2006, the disclosure of which is hereby incorporated by reference in its entirety.

BACKGROUND

The invention relates to a mixture distribution device according to the preamble of claim 1. The invention also relates to a combustion engine provided with such a mixture distribution device.

There are mixture distribution devices known in the art, for instance in the form of a so-called inlet manifold.

With known inlet manifolds, the air/fuel mixture is distributed among a number of engine cylinders. In many cases, an air/fuel mixture consists of a mixture of finely distributed fuel drops of different sizes and evaporated fuel in air. During the flow of the mixture in the inlet manifold, particularly with deflection of the flow, depending on the extent of deflection, the flow rate and the drop size, fuel drops will leave the flow and precipitate on the walls of the manifold as a result of the relatively high mass inertia of the fuel drops. Typically, the larger, consequently heavier fuel drops are the first to precipitate on the walls. The remainder of the fuel will move along with the air flow in vapor form or in drop form to the different engine cylinders. The precipitated fuel, however, makes its way along the walls of the manifold to the different engine cylinders. Particularly this wall transport of fuel imposes very specific requirements on the design of the inlet manifold to obtain a proportional fuel distribution among the different engine cylinders, which is necessary for good engine performance. Above-mentioned specific requirements often result in design concessions with respect to the flow properties of the manifold, including desired optimal inlet length and inlet volume, for the benefit of a proportional fuel distribution, which results in a reduced engine power.

These problems have been one of the reasons for the fact that the known technology of carburetor with inlet manifold in gasoline engines has, in many cases, was abandoned in favor of gasoline injection.

BRIEF SUMMARY

It is an object of the invention to provide an improved solution according to which a mixture distribution device can be designed more suitably with respect to flow technique, without the air/fuel mixture being distributed disproportionally among the different engine cylinders.

To this end, according to the invention, a mixture distribution device according to claim 1 is provided.

By collecting a part of the air/fuel mixture supplied to the first mixture inlet, herein referred to as second fraction, by means of the second mixture inlet and proportionally supplying it, via the second branch guiding structure, to the mutually different first outlet channels of the first branch guiding structure, the second fraction is proportionally distributed among the different engine cylinders. As a result, a large part of the total fuel amount to be supplied to the engine is proportionally distributed among the different engine cylinders. The remaining part, herein referred to as first fraction, can flow along the second mixture inlet and is distributed in the interior of the first branch guiding structure among the different first outlet channels of the first branch guiding structure. Due to this manner of mixture distribution, only the first fraction needs to be proportionally distributed in the interior of the first branch guiding structure, which is simpler than proportional distribution of all the mixture in the interior of the first branch guiding structure. In addition, any occurring disproportional distribution of the first fraction affects the engine performance less since this represents only a part of the total fuel amount to be supplied.

Because the second mixture inlet is situated in an interior portion of the first branch guiding structure and the second mixture inlets open into the interior of the first branch guiding structure, the principal forms of the mixture distribution device and/or the placement of the fuel metering device with respect to the mixture distribution device do not need to be arranged in a special manner. Thus, the usual freedoms of design which are desired to achieve an optimization of the mixture distribution device based on other flow-technical considerations remain within reach.

The invention may also be embodied in a combustion engine according to claim 8.

Specific embodiments of the invention are set forth in the dependent claims.

BRIEF DESCRIPTION OF SEVERAL VIEWS OF THE DRAWINGS

In the following description, illustrative embodiments of the invention is explained in more detail with reference to the schematic Figures in the appended drawings.

DETAILED DESCRIPTION OF THE INVENTION

Figure 1:
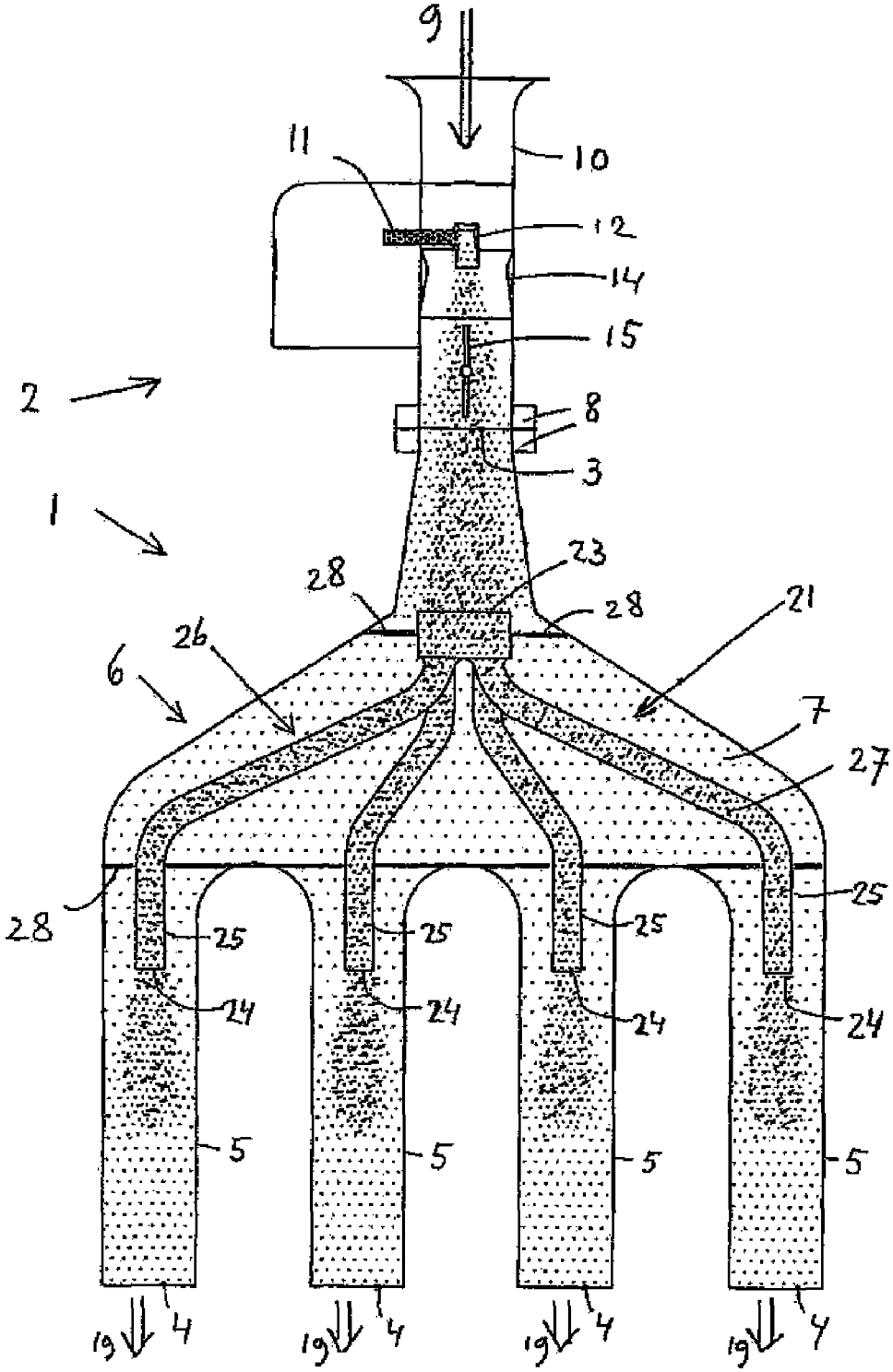
FIG. 1 schematically shows, in side elevational view, an example of an embodiment of a mixture distribution device according to the invention.
Figure 2:
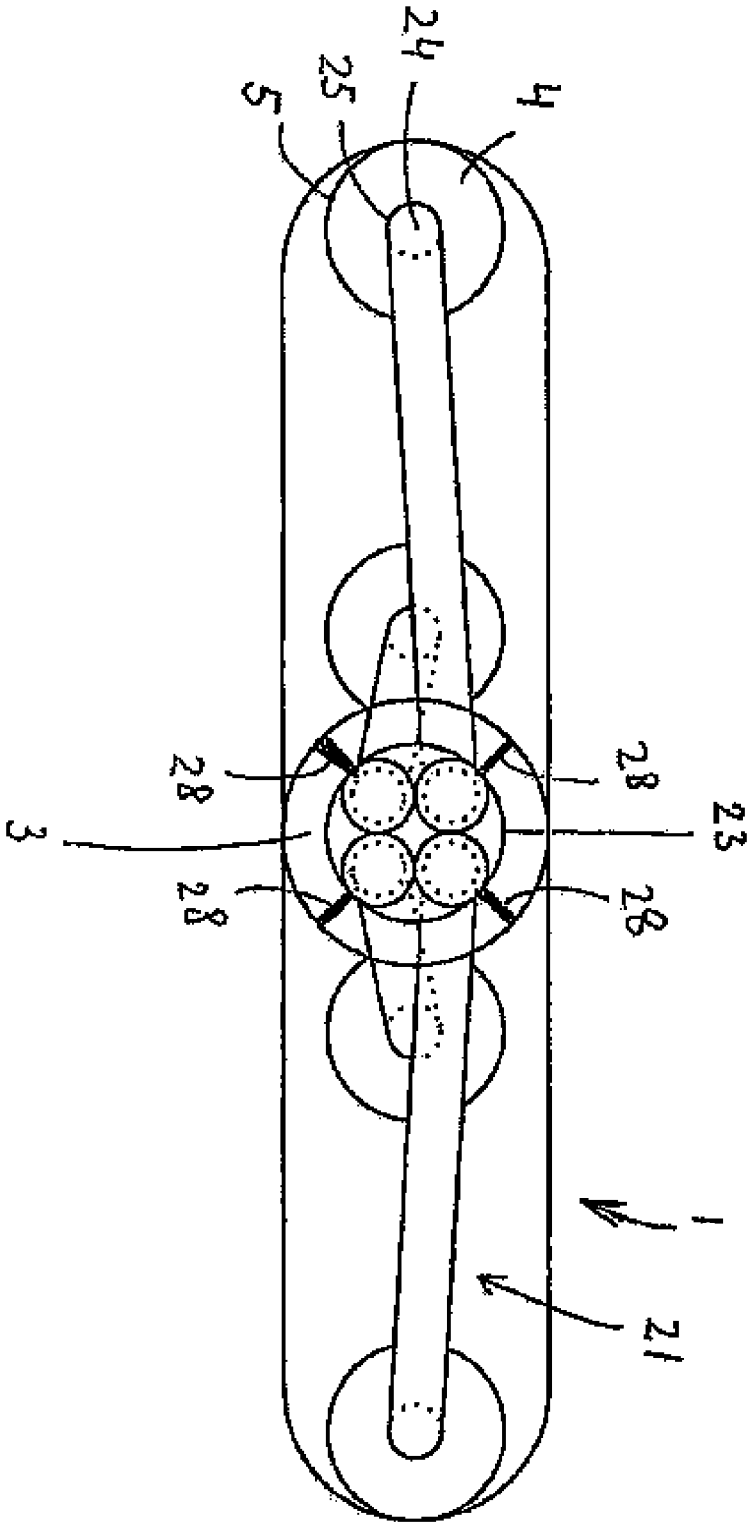
FIG. 2 schematically shows a top plan view of the example of FIG. 1.

Now first reference is made to the example of FIGS. 1 and 2. In FIG. 1, an inlet manifold 1 and a carburetor 2 are shown. In the framework of the present invention, more in general, instead of the inlet manifold 1, another type of mixture distribution device may also be used, while, instead of the carburetor 2, another type of fuel metering device may be used.

In the example, the carburetor 2 has an inlet channel 10 for letting in combustion air in the direction of the arrow 9 in FIG. 1. To the combustion air let in, an air/fuel emulsion 11 is supplied, in the example shown by means of a double venturi 12, 14 in the inlet channel 10. Further downstream in the inlet channel 10, a throttle valve 15 is shown which is in completely opened condition in the example. It is noted that, in the framework of the present invention, the carburetor 2 is by no means limited to the example shown; various types of carburetors may be used. Also, various types of fuel may be used.

In the example shown, the manifold 1 and the carburetor 2 are connected to each other with one of the conventional connecting means, schematically designated by reference numeral 8 in FIG. 1. At the location of the connection to the carburetor, the manifold 1 comprises a first mixture inlet 3 for supplying an air/fuel mixture coming from the carburetor 2 thereto. Further, the manifold 1 comprises multiple first mixture outlets 4 for supplying the mixture supplied to the first mixture inlet 3 to inlets of multiple engine cylinders. The flow of the mixture at the location of the first mixture outlets 4 is indicated by arrows 9 in FIG. 1. It is noted that, in the example shown, the manifold 1 has four first mixture outlets. However, other numbers of first mixture outlets are possible as well.

The manifold 1 further comprises a first branch guiding structure 6 for guiding the mixture in a downstream direction of the mixture from the first mixture inlet 3 to the multiple first mixture outlets 4, while mutually different ones of the first mixture inlets 4 are mutually different mouths of different, mutually branched first outlet channels 5 of the first branch guiding structure 6.

The assembly described so far of the inlet manifold 1 and the carburetor 2 is known from practice.

The manifold 1 further comprises a second mixture distribution device 21 which, in this example, is suspended by means of schematically indicated cross connections 28 from walls of the manifold 1. The invention is not limited to suspensions in the form of such cross connections; various other suspension means and suspension methods may be used. The second mixture distribution device 21 comprises a second mixture inlet 23 situated in an interior part of the first branch guiding structure 6, which interior part is not yet thus branched in the downstream direction, such that the mixture supplied to the first mixture inlet 3 is divided into a first fraction 7 and a second fraction 27 which is not collected and is collected, respectively, by the second mixture distribution device 21 via the second mixture inlet 23. Above-mentioned division is such that the first fraction is sufficiently small for allowing it to be distributed sufficiently well among the different first outlet channels 5 of the first branch guiding structure 6 and is sufficiently large for making a sufficient contribution to the total air/fuel mixture amount to be supplied to the engine, which partly determines the attainable engine power.

It is noted that, in the example, the second mixture inlet 23 is situated centrally in the approaching flow of the mixture. This contributes to a proportional distribution of the second fraction 27 among the different second mixture outlets 24. In other configurations of manifolds and carburetors, second mixture inlets situated differently from centrally in the approaching mixture flow may be more suitable, since air/fuel mixtures from fuel metering devices do not by definition have a homogeneous composition and/or are not concentric with regard to the flow pattern. The shape and position of the second mixture inlet can be laid out with respect thereto, which always allows a suitable position of the second mixture inlet in various configurations.

The second mixture distribution device 21 further comprises multiple second mixture outlets 24. These second mixture outlets 24 open into the interior of the first branch guiding structure 6 for supplying the collected second fraction 27 to the mutually different first outlet channels 5 of the first branch guiding structure 6.

The second mixture distribution device 21 further comprises a second branch guiding structure 26 for guiding the collected second fraction 27 from the second mixture inlet 23 to the multiple second mixture outlets 24, while mutually different ones of the second mixture outlets 24 are mutually different second mouths of different mutually branched second outlet channels 25 of the second branch guiding structure 26.

It is noted that, in the example shown, the respective second mixture outlets 24 are situated in the respective first outlet channels 5 of the first branch guiding structure 6. Instead, the respective second mixture outlets 24 may, however, also be situated in other places with the first branch guiding structure 6, for instance in places somewhat upstream of the respective first outlet channels 5.

It is further noted that in the example shown, in addition to the second mixture inlet 23 and the second mixture outlets 24, the other parts of the second branch guiding structure 26, such as the second outlet channels 25, are also situated in the interior of the first branch guiding structure 6. Instead, it is, however, also possible that such other parts of the second branch guiding structure 26 extend (partly) externally of the first branch guiding structure 6. The latter increases the freedoms of design of the manifold 1 still further and, in addition, has the advantage that the flow of the first fraction 7 in the interior of the first branch guiding structure 6 is hindered less by the presence of the second branch guiding structure 26.

As mentioned hereinabove, the second mixture inlet 23 of the second mixture distribution device 21 is situated in an interior part of the first branch guiding structure, which interior part is not yet thus branched in the downstream direction. So, this means that the second mixture inlet 23 is not situated in the interior of a first outlet channel 5. However, this does not mean that the second mixture inlet 23 needs to be situated in a place higher than the first outlet channels 5, viewed in a similar orientation to FIG. 1. This is because, in an embodiment alternative to the example of FIG. 1, the first branch guiding structure 6 may, for instance, also be designed such that, viewed in a similar orientation to FIG. 1, it comprises a not yet branched interior part which is in or below the height range of one or more of the first outlet channels 5, but is thus not in the interior of a first outlet channel 5. When, in such an alternative embodiment, the second mixture inlet 23 is situated in such a not yet branched part, for instance, the second branch guiding structure 26 can extend partly in the exterior of the first branch guiding structure 6.

In the above-described example, the mixture distribution device is an inlet manifold. However, the mixture distribution device may also be an assembly of an inlet manifold and a cylinder head, while the mixture distribution device is arranged such that, in assembled condition of the assembly, at least one of the second outlet channels of the second branch guiding structure has its second mixture inlet open into an interior part of the cylinder head. For instance, the cylinder head of the assembly may have an inlet channel which connects to an outlet of the inlet manifold of the assembly, which inlet channel branches downstream in the cylinder head into branch channels which are intended to be connected to separate engine cylinders. One or more of the second outlet channels of the second branch guiding structure can then have its/their second mixture outlet(s) open into the cylinder head inlet channel or into one or more of the branch channels in the cylinder head. In this manner, also in the case of such an assembly, the mixture can be prevented from being disproportionally distributed among different engine cylinders.

Figure 3:
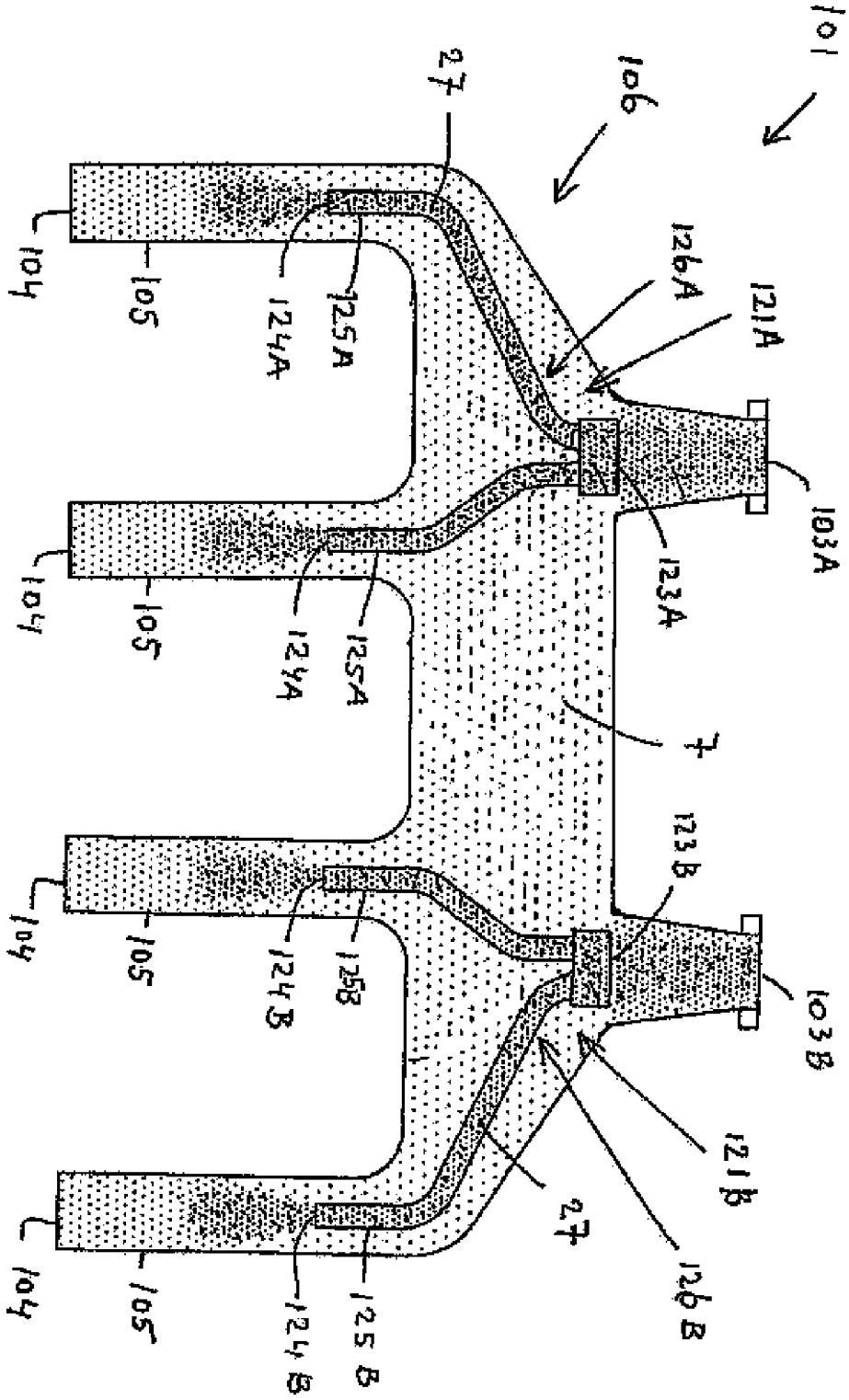
FIG. 3 schematically shows, in side elevational view, an example of another embodiment of a mixture distribution device according to the invention.

Reference is now made the example of FIG. 3, where an inlet manifold 101 is shown which, similarly to the example of FIGS. 1 and 2, comprises a first branch guiding structure 106 and multiple first mixture outlets 104, while the first mixture outlets 104 are mouths of first outlet channels 105 of the first branch guiding structure 106.

A difference from the example of FIGS. 1 and 2 is that the manifold 101 comprises not one but multiple first mixture inlets for supplying an air/fuel mixture coming from a fuel metering device thereto. In the example shown, these are two first mixture inlets 103A and 103B. For instance, the two first mixture inlets 103A and 103B can be connected to two single carburetors or to one twin carburetor (carburetor having two inlet channels).

A further difference from the example of FIGS. 1 and 2 is that the manifold 101 comprises not one but multiple second mixture distribution devices. In the example shown, these are two second mixture distribution devices 121A and 121B, namely a second mixture distribution device 121A for the first mixture inlet 103A, and a second mixture distribution device 121B for the first mixture inlet 103B.

The second mixture distribution device 21A comprises a second mixture inlet 123A, two second mixture outlets 124A and a second branch guiding structure 126A, while the second mixture distribution device 121B comprises a second mixture inlet 123B, two second mixture outlets 124A and a second branch guiding structure 126B, all this similarly to the example of FIGS. 1 and 2. In operation, the second mixture inlet 123A provides the division, into a first fraction 7 and a second fraction 27, of the mixture supplied to the first mixture inlet 103A, and the second mixture inlet 123B provides such a division of the mixture supplied to the first mixture inlet 103B. Here, the collected second fractions 27 are supplied to the mutually different first outlet channels 105 via the second mixture outlets 124A and 124B.

The example of FIG. 3 shows that, also in the case that a mixture distribution device comprises multiple mixture inlets, it can be achieved in an effective manner that the air/fuel mixture can be proportionally distributed among the different engine cylinders. For instance, a mixture distribution device is possible for a V8 engine, where the mixture distribution device can have four first mixture inlets with, for each first mixture inlet, such a second mixture distribution device provided with two second mixture outlets. In that manner, for each of the eight cylinders of the V8 engine, a second mixture outlet is provided.

Another, more typical embodiment for a V8 engine is that use is made of a so-called four-stroke carburetor which is placed on the inlet manifold as one whole. In this embodiment, the manifold has one first mixture inlet into which four air/fuel mixture flows flow which provide the eight cylinders with air/fuel mixture. In this case, an embodiment is possible where, for each air/fuel mixture flow flowing from the carburetor, a second mixture distribution device is provided.

More in general, the mixture distribution device according to the invention may be provided with an assembly of at least two similar such second mixture distribution devices, each associated with the first mixture inlet. If then, for instance like in the example of FIG. 3, the mixture distribution device comprises multiple similar such first mixture inlets, and, for each of at least two of those first mixture inlets, a similar such second mixture distribution device, the mixture distribution device for each of at least two of the multiple similar such first mixture inlets may be provided with such an assembly.

It is noted that the above-mentioned examples of embodiments do not limit the invention and that various alternatives are possible within the scope of the appended claims. Thus, various types of first and second branch guiding structures are possible, for instance also those where pipes are branched from already branched pipes. The mixture distribution device and the second mixture distribution device may be manufactured in various manners, for instance by means of molding, sheet-metal work, milling, or the like. They may also be manufactured from various materials, for instance from aluminum or steel.

Further, various dimensions of various parts of the mixture distribution device are possible. As a non-limiting example, in the examples shown, for instance the following combination of dimensions can be used: the first mixture inlet(s), the second mixture inlet(s) and the first mixture outlets may, for instance, each have an internal diameter of approximately 40 mm, while the second mixture outlets may, for instance, each have an internal diameter of approximately 12 mm, and while, around the second mixture inlet(s), the shortest distance from the exterior of the second mixture inlet(s) to the interior walls of the manifold is, for instance, approximately 10 mm for allowing the first fraction to flow along the second mixture inlet(s). However, as mentioned, various other dimensions and combinations thereof can be used.

Further, the second mixture inlet and the second branch guiding structure may also be understood to mean a situation in which the second mixture inlet is formed by an assembly of multiple more or less separate second mixture inlets, while the mutually branched second outlet channels of the second branch guiding structure axe branched with respect to each other as a result of the separate character of the assembled second mixture inlets.

From the foregoing, it will be appreciated that although specific embodiments of the invention have been described herein for purposes of illustration, various modifications may be made without deviating from the spirit or scope of the invention. Such and similar alternatives are understood to fall within the framework of the invention as defined in the appended claims. It is therefore intended that the foregoing detailed description be regarded as illustrative rather than limiting, and that it be understood that it is the following claims, including all equivalents, that are intended to particularly point out and distinctly claim the subject matter regarded as the invention.

What is claimed is:

1. A mixture distribution device for a combustion engine, comprising a first mixture inlet (3; 103A, 103B) for supplying an air/fuel mixture coming from a fuel metering device (2) thereto;

multiple first mixture outlets (4; 104) for supplying the mixture supplied to the first mixture inlet to inlets of multiple engine cylinders; and a first branch guiding structure (6; 106) for guiding the mixture in downstream direction of the mixture from the first mixture inlet to the multiple first mixture outlets, wherein mutually different ones of the first mixture outlets are mutually different mouths of different, mutually branched first outlet channels (5; 105) of the first branch guiding structure; characterized by a second mixture distribution device (21; 121A, 121B), comprising a second mixture inlet (23; 123A, 123B) situated in an interior part of the first branch guiding structure 6, which interior part is not yet thus branched in the downstream direction, such that the mixture supplied to the first mixture inlet is divided into a first fraction (7) and a second fraction (27) which is not collected and is collected, respectively, by the second mixture distribution device via the second mixture inlet;

multiple second mixture outlets (24; 124A, 124B) opening into the interior of the first branch guiding structure, for supplying the collected second fraction (7) to the mutually different first outlet channels; and a second branch guiding structure (26; 126A, 126B) for guiding the collected second fraction (27) from the second mixture inlet to the multiple second mixture outlets, wherein mutually different second mixture outlets are mutually different second mouths of different mutually branched second outlet channels (25; 125A, 125B) of the second branch guiding structure.

2. A mixture distribution device according to claim 1, wherein the mixture distribution device (101) comprises multiple similar such first mixture inlets (103A, 103B), and, for each of at least two of those first mixture inlets (103A, 103B), a similar such second mixture distribution device (121A, 121B).

3. A mixture distribution device according to claim 1, wherein the mixture distribution device is provided with an assembly of at least two similar such second mixture distribution devices, each associated with the first mixture inlet.

4. A mixture distribution device according to claim 1, wherein the mixture distribution device (101) comprises multiple similar such first mixture inlets (103A, 103B), wherein, for each one of at least two of the multiple similar such first mixture inlets, the mixture distribution device is provided with an assembly of at least two similar such second mixture distribution devices, each being associated with the concerning first mixture inlet.

5. A mixture distribution device according to claim 1, wherein the mixture distribution device (1: 101) is an inlet manifold.

6. A combustion engine comprising a mixture distribution device (1; 101) according to claim 1.

* * * * *

UNITED STATES PATENT AND TRADEMARK OFFICE

CERTIFICATE OF CORRECTION

PATENT NO. : 7,789,058 B2
APPLICATION NO. : 11/952277
DATED : September 7, 2010
INVENTOR(S) : Martinus Hendrikus Rotink It is certified that error appears in the above-identified patent and that said Letters Patent is hereby corrected as shown below:

Please correct the Inventor's address by changing "Steggerdawng" to -- Steggerdaweg --. The correct address should be as follows:

(76) Inventor: Martinus Hendrikus Rotink,
Steggerdaweg 20, 8395PN, Steggerda
(NL)

Signed and Sealed this
Eighth Day of March, 2011

David J. Kappos

David J. Kappos
*Director of the United States Patent and Trademark Office*